US010087703B2

(12) United States Patent
Thorn

(10) Patent No.: US 10,087,703 B2
(45) Date of Patent: Oct. 2, 2018

(54) WELL TOOLS WITH SEMI-PERMEABLE BARRIER FOR WATER-SWELLABLE MATERIAL

(71) Applicant: HALLIBURTON ENERGY SERVICES, INC., Houston, TX (US)

(72) Inventor: Adrian D. Thorn, Shropshire (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/408,507

(22) PCT Filed: Sep. 17, 2012

(86) PCT No.: PCT/US2012/055808
§ 371 (c)(1),
(2) Date: Dec. 16, 2014

(87) PCT Pub. No.: WO2014/042657
PCT Pub. Date: Mar. 20, 2014

(65) Prior Publication Data

US 2015/0176365 A1 Jun. 25, 2015

(51) Int. Cl.
*E21B 34/06* (2006.01)
*E21B 33/12* (2006.01)
*E21B 41/00* (2006.01)

(52) U.S. Cl.
CPC ..... *E21B 33/1208* (2013.01); *E21B 41/00* (2013.01)

(58) Field of Classification Search
CPC ..... E21B 33/12; E21B 33/1208
See application file for complete search history.

(56) References Cited

U.S. PATENT DOCUMENTS

| | | | | |
|---|---|---|---|---|
| 5,236,689 | A | 8/1993 | Wong et al. | |
| 7,527,099 | B2 | 5/2009 | Bosma et al. | |
| 7,562,704 | B2 | 7/2009 | Wood et al. | |
| 7,681,653 | B2 | 3/2010 | Korte et al. | |
| 7,819,200 | B2 | 10/2010 | Cornelissen et al. | |
| 2007/0056735 | A1 | 3/2007 | Bosma et al. | |
| 2008/0283238 | A1* | 11/2008 | Richards | E21B 23/04 166/228 |
| 2009/0178800 | A1 | 7/2009 | Korte et al. | |

(Continued)

FOREIGN PATENT DOCUMENTS

EP 1649136 B1 10/2006

OTHER PUBLICATIONS

International Search Report with Written Opinion dated Apr. 22, 2013 for PCT Patent Application No. PCT/US2012/055808, 13 pages.

(Continued)

*Primary Examiner* — D. Andrews
(74) *Attorney, Agent, or Firm* — Locke Lord LLP; Christopher J. Capelli; Joshua L. Jones

(57) ABSTRACT

A method of operating a well tool can include a swellable material of the well tool swelling in a subterranean well, in response to water in the well entering the swellable material, and a semi-permeable barrier layer permitting the water to pass through the barrier layer and into the swellable material. A system can include a well tool having a swellable material which swells in response to contact with water, and a semi-permeable barrier layer on an exterior surface of the swellable material, the barrier layer being permeable to the water.

6 Claims, 3 Drawing Sheets

(56) References Cited

U.S. PATENT DOCUMENTS

| | | | |
|---|---|---|---|
| 2010/0181080 | A1 | 7/2010 | Levy |
| 2011/0027599 | A1 | 2/2011 | Hoek et al. |
| 2011/0073310 | A1 | 3/2011 | Clemens et al. |
| 2012/0009266 | A1 | 1/2012 | Khanna et al. |
| 2012/0175134 | A1 | 7/2012 | Robisson et al. |

OTHER PUBLICATIONS

Wikipedia; "Superabsorbent Polymer", free encyclopedia article, dated Jul. 29, 2012, 5 pages.

* cited by examiner

WELL TOOLS WITH SEMI-PERMEABLE BARRIER FOR WATER-SWELLABLE MATERIAL

CROSS-REFERENCE TO RELATED APPLICATION

This application is a national stage under 35 USC 371 of International Application No. PCT/US12/55808, filed on 17 Sep. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a semi-permeable barrier for swellable materials used in well tools.

BACKGROUND

It is known to use swellable materials in well tools. For example, swellable materials may be used in annular seals of packers, in actuators for valves or other types of well tools, etc.

However, in some circumstances, a swellable material may not swell consistently, or the swellable material may not retain its maximum swell volume. Therefore, it will be appreciated that improvements are continually needed in the art of utilizing swellable materials in well tools.

SUMMARY

In this disclosure, systems and methods are provided which bring improvements to the art of constructing well tools with swellable materials. One example is described below in which an outer semi-permeable barrier layer prevents ions of a salt in the swellable material from exiting the swellable material. Another example is described below in which a semi-permeable barrier layer prevents valence cations from entering the swellable material.

A method of operating a well tool is provided to the art. In one example, the method comprises a swellable material of the well tool swelling in a subterranean well, in response to water in the well entering the swellable material, and a semi-permeable barrier layer permitting the water to pass through the barrier layer and into the swellable material.

A well tool is also provided to the art. In one example, the well tool can comprise a swellable material which swells in response to contact with water, and a semi-permeable barrier layer on an exterior surface of the swellable material, the barrier layer being permeable to the water.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
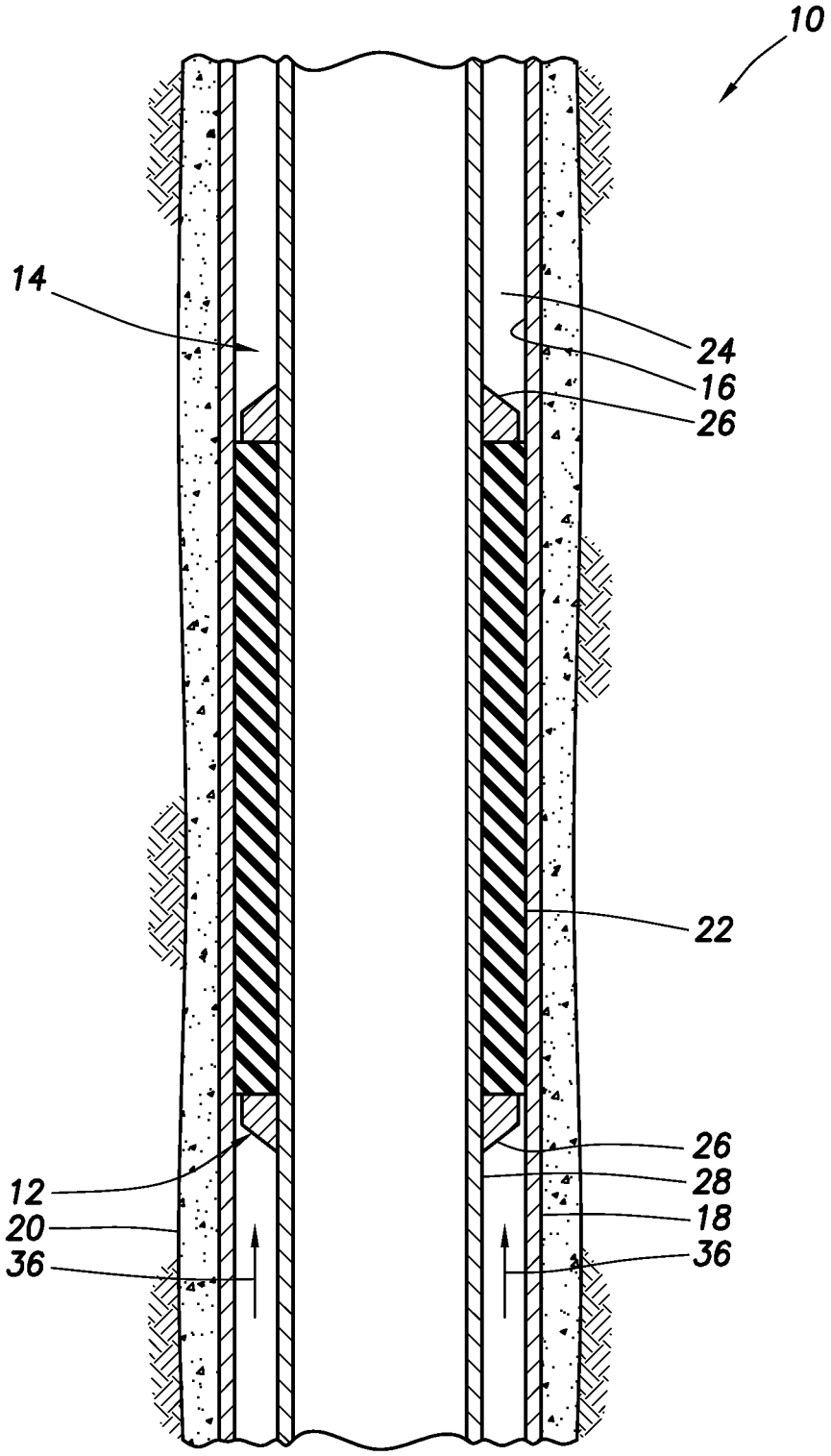
FIG. 1 is a representative partially cross-sectional view of a system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a swellable packer assembly 12 is interconnected as part of a tubular string 14 positioned in a wellbore 16. The wellbore 16 may be lined with casing 18 and cement 20, or in other examples the wellbore may be uncased or open hole.

The packer assembly 12 includes an annular seal element 22 for sealing off an annulus 24 formed radially between the tubular string 14 and the wellbore 16. The seal element 22 seals off the annulus 24 by swelling in response to contact with a particular activating agent (e.g., a particular fluid) in the well.

The seal element 22 is longitudinally straddled by end rings 26 secured to a base pipe 28. The seal element 22 and end rings 26 may be configured in a variety of different ways (for example, including anti-extrusion devices, reinforcements, materials with different swelling characteristics, etc.). Thus, it should be clearly understood that the scope of this disclosure is not limited to any particular construction or configuration of a packer assembly. Indeed, the scope of this disclosure is not limited to packer assemblies at all, since other types of well tools (e.g., valves, chokes, actuators, fluid type selectors, etc.) can incorporate this disclosure's principles.

Figure 2:
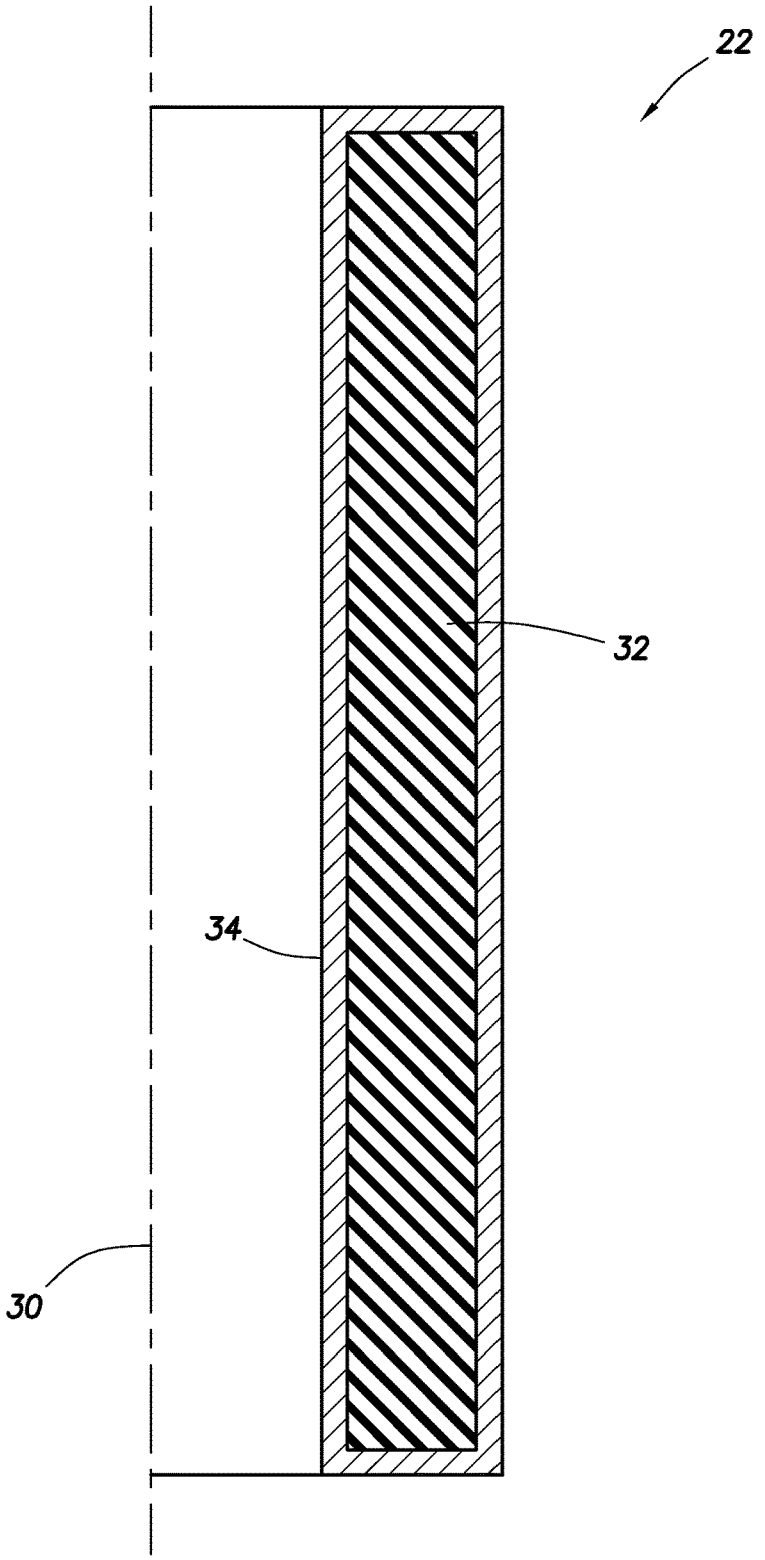
FIG. 2 is a representative cross-sectional view of a swellable seal element which may be used in the system and method of FIG. 1.

Referring additionally now to FIG. 2, a more detailed cross-sectional view of the seal element 22 is representatively illustrated. The seal element 22 may be used in the system 10 and method of FIG. 1, or it may be used in other systems or methods.

In this example, the seal element 22 is annular shaped, but other shapes may be used if desired. The seal element 22 is symmetrical about its centerline 30, but in other examples the seal element may not be symmetrical. The scope of this disclosure is not limited to any particular shape or type of seal element, and is not limited to seal elements at all.

The seal element 22 depicted in FIG. 2 includes a swellable material 32 and an exterior semi-permeable barrier layer 34 on all external surfaces of the seal element. In this example, the barrier layer 34 completely envelopes the swellable material 32, so that the activating agent passes through the barrier layer 34 to contact the swellable material.

In other examples, the barrier layer 34 may not cover all external surfaces of the swellable material 32. For example, if the base pipe 28 isolates an inner diameter of the swellable material 32 from well fluids, then the barrier layer 34 may not be used on the inner diameter. Similarly, if the end rings 26 isolate ends of the swellable material 32 from well fluids, the barrier layer 34 may not be used on the ends.

Preferably, the swellable material 32 swells when it is contacted with a particular activating agent in the well. The activating agent may already be present in the well, or it may be introduced after installation of the packer assembly 12 in the well, or it may be carried into the well with the packer assembly, etc.

Thus, it will be appreciated that a wide variety of different ways of swelling the swellable material 32 exist and are known to those skilled in the art. Accordingly, the scope of this disclosure is not limited to any particular manner of swelling the swellable material 32. Furthermore, the scope of this disclosure is also not limited to any of the details of the system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 32 is preferably water in this example. The water may originate in the well, or it may be introduced into the well.

Various materials are known to swell in the presence of water. Super-absorbent material (such as cellulose, clay, polyacrylates, polyacrylamides, etc.) can be used. Osmotic activity with a salt-like material may be used.

A salt and/or a superabsorbent polymer (e.g., polyacrylate, polyacrylamide, hydrogels, sodium polyacrylate, polyacrylamide copolymer, ethylene maleic anhydride copolymer, cross-linked carboxymethylcellulose, polyvinyl alcohol copolymers, cross-linked polyethylene oxide, starch grafted copolymer of polyacrylonitrile, etc., which absorb aqueous solutions through hydrogen bonding with water molecules) can be incorporated into materials such as rubber, other elastomers or non-elastomers to form the swellable material 32.

In addition to being swellable in response to contact with water, the swellable material 32 may also swell in response to contact with a hydrocarbon fluid (such as oil or gas), an acid, a fluid having a particular pH or a particular chemical, etc. Activating agent(s) which cause swelling of the swellable material 32 could be comprised in any type of fluid.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

In the system 10 of FIG. 1, the swellable material 32 swells when a fluid 36 comprises the activating agent (e.g., when the fluid enters the wellbore 16 from a formation surrounding the wellbore, when the fluid is circulated to the packer assembly 12 from the surface, when the fluid is released from a chamber carried with the packer assembly, etc.). In response, the seal element 22 swells radially outward, seals off the annulus 24 and applies a gripping force to the wellbore 16.

In other examples, the seal element 22 could swell radially inward, longitudinally, laterally, or in any other direction or combination of directions. It is not necessary for the annulus 24 to be sealed off, for any seal to be effected, or for the swellable material 32 to be used in a seal element, in keeping with the principles of this disclosure.

In some examples, the swellable material 32 may include a salt (e.g., sodium acetate, etc.) which is dissolved when water enters the swellable material via the barrier layer 34. The barrier layer 34 can, in that case, permit the water to pass through the barrier layer and into contact with the swellable material 32, but can prevent ions of the salt from passing out of the swellable material via the barrier layer.

This will prevent, or at least mitigate, "un-swelling" of the swellable material 32 (a decrease in volume) which could result from loss of the salt ions from the swellable material. Thus, the barrier layer 34 in these examples is permeable to water, but is impervious to the salt ions produced in the swellable material 32.

In some examples, the swellable material 32 may include a superabsorbent polymer (e.g., a polyacrylate, polyacrylamide, etc.), the swelling of which is reduced by the presence of valence cations (such as, cations of divalent metals in the fluid 36, etc.). Valence cations are known to exist in common well fluids (e.g., brine water, etc.). In that case, the barrier layer 34 can permit the water, but not the valence cations, to pass through the barrier layer and into contact with the swellable material 32.

This will allow the swellable material 32 to fully swell in response to contact with the water, preventing (or at least mitigating) any negative effect of the valence cations. Thus, the barrier layer 34 in these examples is permeable to water, but is impervious to valence cations in the fluid 36 (such as brine water, etc.).

Figure 3:
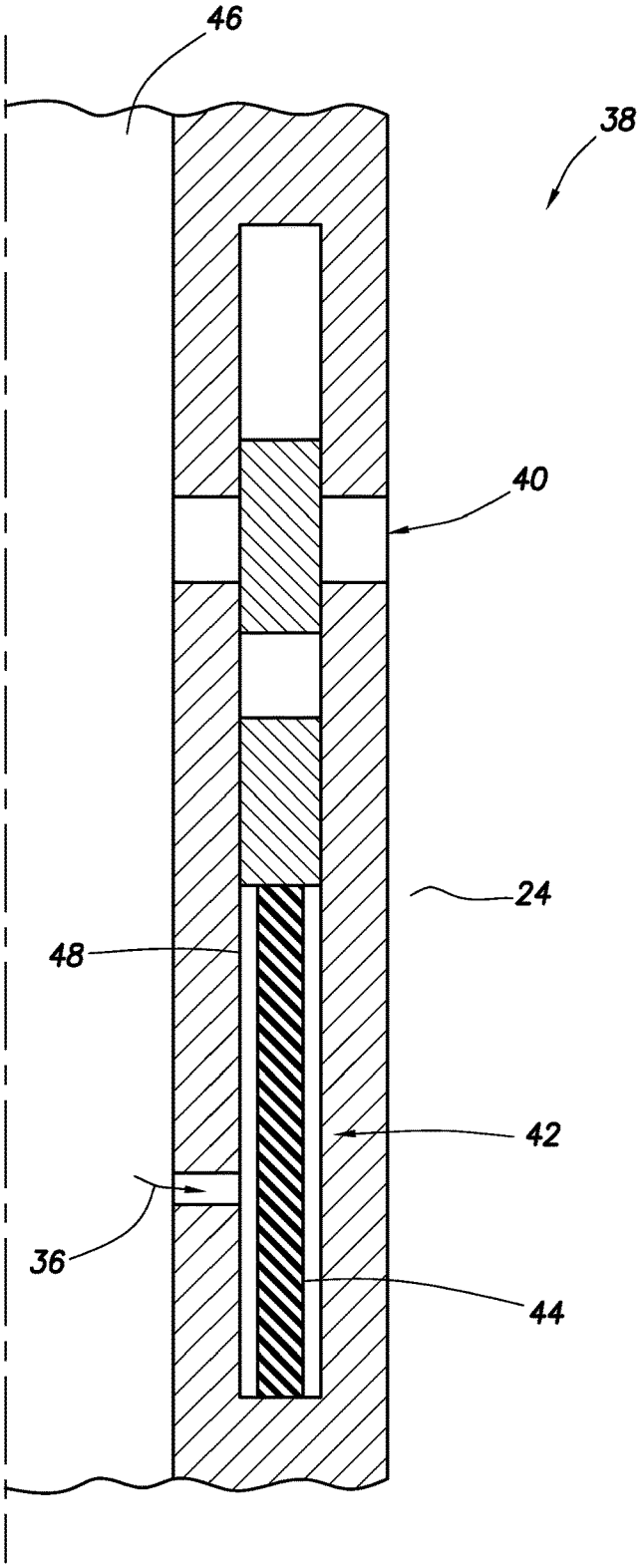
FIG. 3 is a representative cross-sectional view of an example of a well tool which can embody principles of this disclosure.

Referring additionally now to FIG. 3, a cross-sectional view of another well tool 38 is representatively illustrated. The well tool 38 may be used in the system 10 and method of FIG. 1 in addition to, or in substitution for, the packer assembly 12. Of course, the well tool 38 can be used in other systems and methods without departing from the principles of this disclosure.

In this example, the well tool 38 comprises a valve 40 and an actuator 42. The valve 40 opens when an actuator member 44 swells in response to contact with one or more activating agents.

The actuator member 44 can be similar to the seal element 22 described above, in that, the actuator member can include the swellable material 32 with the barrier layer 34 on one or more exterior surfaces thereof. However, the actuator member 44 is not necessarily annular shaped, and does not seal against any surface. Instead, the actuator member 44 is configured as appropriate for displacing a structure of the valve, in order to actuate the valve.

In the FIG. 3 example, the actuator member 44 swells when the fluid 36 enters a chamber 48 from a flow passage 46 extending longitudinally through the well tool 38. When the well tool 38 is interconnected as part of the tubular string 14, the flow passage 46 extends longitudinally through the tubular string.

In other examples, the fluid 36 could flow from the annulus 24, or from another chamber in the well tool 38, into contact with the actuator member 44. Thus, the scope of this disclosure is not limited to any particular construction, configuration or manner of actuating the well tool 38.

The well tool 38 demonstrates that the principles of this disclosure can be applied to a wide variety of different types of well tools. A packer assembly 12 and a valve assembly (well tool 38) are merely two examples of well tools which can incorporate the principles of this disclosure.

The barrier layer 34 can be applied to the swellable material 32 using any technique. For example, the barrier layer 34 could be painted, sprayed, wrapped, coated, molded or otherwise applied to exterior surfaces of the swellable material 32. The barrier layer 34 can comprise a coating, film or membrane on the swellable material 32.

In some examples, the barrier layer 34 may comprise a dense nonporous polymer film. Suitable materials for use as the barrier layer 34 can include cellulose coatings, silicone coatings, polyetheroxide-polybutyleneterephtalate block copolymer systems, acrylate/methacrylate systems, FKM/FFKM fluoroelastomer coatings, polyurethane coatings/lacquers and flexible epoxy systems. However, any suitable semi-permeable material may be used, in keeping with the scope of this disclosure.

It can now be fully appreciated that the above disclosure provides significant advancements to the art of constructing well tools with swellable materials. In one example described above, an outer semi-permeable barrier layer 34 prevents ions of a salt in the swellable material 32 from exiting the swellable material. Another example is described above in which a semi-permeable barrier layer 34 prevents valence cations from entering the swellable material 32.

A method of operating a well tool 38 (or packer assembly 12) is provided to the art by the disclosure above. In one example, the method can comprise: a swellable material 32 of the well tool 12, 38 swelling in a subterranean well, in response to water in the well entering the swellable material 32; and a semi-permeable barrier layer 34 permitting the water to pass through the barrier layer 34 and into the swellable material 32.

The barrier layer 34 may be interposed between the swellable material 32 and a source of the water (such as, the annulus 24, the flow passage 46, a chamber in the well tool, etc.).

The barrier layer 34 may prevent ions of salt dissolved by the water from passing out of the swellable material 32. The barrier layer 34 can be impervious to ions of salt in the swellable material 32.

The barrier layer 34 may be impervious to valence cations. The barrier layer 34 may prevent cations of divalent metals in the water from passing through the barrier layer 34 with the water.

The barrier layer 34 may envelope the swellable material 32.

The method can also include sealing off an annulus 24 in the well as a result of the swelling, and/or actuating the well tool 12, 38 as a result of the swelling.

The swellable material 32 may comprise a superabsorbent polymer.

A well tool 12, 38 is also described above. In one example, the well tool 12, 38 can comprise a swellable material 32 which swells in response to contact with water, and a semi-permeable barrier layer 34 on an exterior surface of the swellable material 32, the barrier layer 34 being permeable to the water.

A system 10 for use with a subterranean well is also described above. In one example, the system 10 can comprise a well tool 12, 38 including a swellable material 32 which swells in response to contact with water in the well, and a semi-permeable barrier layer 34 on an exterior surface of the swellable material 32, the barrier layer 34 being permeable to the water.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of operating a well tool, the method comprising:

a swellable material of the well tool swelling in a subterranean well, in response to water in the well entering the swellable material, wherein swelling of the swellable material in an axial direction of the well tool aligns a radial opening in a valve with a radial opening in the well tool to permit fluid flow through the radial openings; and a semi-permeable barrier layer permitting the water to pass through the barrier layer and into the swellable material, wherein the barrier layer prevents ions of salt dissolved by the water from passing out of the swellable material.

2. A method of operating a well tool as recited in claim 1, wherein the swellable material is in an annular shape, and wherein the barrier layer completely envelopes the swellable material on all external surfaces of the annular shape.

3. A well tool, comprising:

a swellable material which swells in response to contact with water;

a semi-permeable barrier layer on an exterior surface of the swellable material, the barrier layer being permeable to the water, wherein the barrier layer prevents ions of salt dissolved by the water from passing out of the swellable material, wherein the swellable material is in an annular shape, and wherein the barrier layer completely envelopes the swellable material on all external surfaces of the annular shape;

a valve having a radial opening; and a well tool radial opening, wherein the swellable material is configured so that swelling of the swellable material in an axial direction of the well tool aligns the radial opening of the valve with the well tool radial opening to permit fluid flow through the radial opening of the valve and the well tool radial opening.

4. A well tool, comprising:

a swellable material which swells in response to contact with water;

a semi-permeable barrier layer on an exterior surface of the swellable material, the barrier layer being permeable to the water, wherein the barrier layer is impervious to ions of salt in the swellable material, wherein the swellable material is in an annular shape, and wherein the barrier layer completely envelopes the swellable material on all external surfaces of the annular shape;

a valve having a radial opening; and a well tool radial opening, wherein the swellable material is configured so that swelling of the swellable material in an axial direction of the well tool aligns the radial opening of the valve with the well tool radial opening to permit fluid flow through the radial opening of the valve and the well tool radial opening.

5. A system for use with a subterranean well, the system comprising:

a well tool including a swellable material which swells in response to contact with water in the well, and a semi-permeable barrier layer on an exterior surface of the swellable material, the barrier layer being permeable to the water, wherein the barrier layer prevents ions of salt dissolved by the water from passing out of the swellable material, wherein the swellable material is in an annular shape, and wherein the barrier layer completely envelopes the swellable material on all external surfaces of the annular shape;

a valve having a radial opening; and a well tool radial opening, wherein the swellable material is configured so that swelling of the swellable material in an axial direction of the well tool aligns the radial opening of the valve with the well tool radial opening to permit fluid flow through the radial opening of the valve and the well tool radial opening.

6. A system for use with a subterranean well, the system comprising:

a well tool including a swellable material which swells in response to contact with water in the well, and a semi-permeable barrier layer on an exterior surface of the swellable material, the barrier layer being permeable to the water, wherein the barrier layer is impervious to ions of salt in the swellable material, wherein the swellable material is in an annular shape, and wherein the barrier layer completely envelopes the swellable material on all external surfaces of the annular shape;

a valve having a radial opening; and a well tool radial opening, wherein the swellable material is configured so that swelling of the swellable material in an axial direction of the well tool aligns the radial opening of the valve with the well tool radial opening to permit fluid flow through the radial opening of the valve and the well tool radial opening.

* * * * *